US005630505A

United States Patent [19]

Garcia

[11] Patent Number: 5,630,505

[45] Date of Patent: May 20, 1997

[54] COVER FOR TOOTHBRUSH HOLDER

[76] Inventor: Guadalupe M. Garcia, 1123 Hacienda Way, Santa Maria, Calif. 93454

[21] Appl. No.: 560,014

[22] Filed: Nov. 17, 1995

[51] Int. Cl.[6] ..... B65D 81/00

[52] U.S. Cl. ..... 206/362.1; 220/367.1

[58] Field of Search ..... 286/209, 209.1, 286/361, 362, 362.1, 362.2, 362.3, 362.4; 220/367.1

[56] References Cited

U.S. PATENT DOCUMENTS

| | | | |
|---|---|---|---|
| D. 291,268 | 8/1987 | Stephenson . | |
| D. 301,660 | 6/1989 | Ambasz . | |
| D. 310,913 | 10/1990 | Ambasz . | |
| D. 310,915 | 10/1990 | Ambasz . | |
| 928,542 | 7/1909 | Ryan | 206/209.1 |
| 1,224,696 | 5/1917 | Wise | 206/209.1 |
| 1,488,961 | 4/1924 | Walbridge | 206/362.2 |
| 1,507,466 | 9/1924 | Collins | 206/209.1 |
| 1,566,860 | 12/1925 | Hainzigianis | 206/362.1 |
| 2,294,631 | 9/1942 | Rocca | 206/362.2 |
| 2,394,640 | 2/1946 | Singer | 206/362.3 |
| 2,400,445 | 5/1946 | Tucker | 206/362.1 |
| 2,667,395 | 1/1954 | Ushanoff | 206/362.2 |
| 3,746,162 | 7/1973 | Bridges . | |
| 4,570,652 | 2/1986 | Chavez . | |
| 4,915,219 | 4/1990 | Ottimo . | |
| 4,997,629 | 3/1991 | Marchand et al. | 206/362.1 |
| 5,139,142 | 8/1992 | Simon . | |
| 5,295,575 | 3/1994 | Gonzalez . | |
| 5,375,711 | 12/1994 | Bree et al. | 206/362.2 |

*Primary Examiner*—Jimmy G. Foster
*Attorney, Agent, or Firm*—Richard C. Litman

[57] ABSTRACT

A ventilated cover for a toothbrush holder is formed to fit closely over a toothbrush cup, and to prevent entry of flies and other insects and airborne pests and carriers of disease organisms within the cup and cover. The cover includes a multitude of very fine holes therethrough, which holes provide air circulation to aid in the drying of the bristles of any toothbrushes contained within the cup and under the cover, but which holes are too small to allow passage of any airborne pests or insects. The cover is preferably formed of plastic, but may alternatively be formed of ceramic, a durable perforated metal, or even a fine mesh screen. The present invention may also include a toothbrush cup and a disc adapted to fit within the upper rim of the cup, with the disc providing upstanding support for one or more toothbrushes held within the cup. The disc may also provide for the positioning of the cover thereover. The cover and/or assembly may be provided in any of a variety of colors and designs, if desired.

8 Claims, 2 Drawing Sheets

COVER FOR TOOTHBRUSH HOLDER

FIELD OF THE INVENTION

The present invention relates generally to special receptacles and containers adapted for special purposes, and more specifically to a specialized perforated cover adapted for placement over the bristled heads of one or more toothbrushes stored in a toothbrush holder or cup. The cover provides air flow therethrough to any toothbrushes contained thereunder to promote drying of the brushes, while simultaneously preventing contact with the brushes by insects or other potential airborne disease vectors.

BACKGROUND OF THE INVENTION

The transmission of disease by various airborne vectors (flies and other insects and the like) has been known for a considerable time. Accordingly, the installation of window screens to prevent the entrance of such pests into the household interior, and other protective covers and containers for use in the kitchen or pantry, are well known.

However, one area of the home or business which receives little concern over such airborne insects and pests, is the bathroom, lavatory, or washroom. While most articles may be stored in a bathroom cabinet, chest, or other enclosure, toothbrushes are often stored in a holder exposed to the open air, so the bristles may dry between uses. This is desirable, as it is also well known that many bacteria and other microorganisms which are hazardous to humans, generally require a relatively warm and moist environment for incubation and are killed or at least rendered inactive in dry conditions.

Thus, the exposure of toothbrushes to the ambient environment may promote drying, but it also exposes the bristles to airborne carriers of bacterial and viral organisms which may cause various diseases. This is all the more evident in the bathroom environment, where the necessary sanitary conditions for the storage of toothbrushes and the like, are in extremely close proximity to other relatively unsanitary facilities, such as toilets and drains.

Accordingly, a need will be seen for a ventilated cover for a toothbrush holder or cup, which cover precludes passage of insects or other airborne disease vectors and the like, while simultaneously promoting the drying of the bristles of toothbrushes stored therein by means of air circulation through the multitude of small air passages in the cover. The cover may be adapted for placement over a conventional toothbrush cup or the like, or alternatively may be formed to fit with a specialized toothbrush container or holder. The cover may be formed of plastic or other durable but lightweight material, or alternatively may be formed of ceramic or a metal or plastic screen, as desired.

DESCRIPTION OF THE PRIOR ART

U. S. Pat. No. 3,746,162 issued to Roy G. Bridges on Jul. 17, 1973 describes a Toothbrush Container comprising a small box which secures about the bristles of a toothbrush to enclose the head or bristle portion of the brush. The handle portion extends from an opening in one end of the box. A lid is provided to complete the closure of the box. By contrast, the present device is a cover for a cup or holder providing for the storage of a plurality of brushes, and seats upon an underlying cup or holder.

U.S. Pat. No. 4,570,652 issued to Michael Chavez on Feb. 18, 1986 describes a Toothbrush Container generally comprising a cylindrical container, and having a variety of interchangeable end portions providing for the containment of a disinfectant therein, and alternatingly for the drying of a toothbrush contained therein. Plural containers may be placed in a manifold container of disinfectant, and removed therefrom for drying after a period of time. The resulting device is quite complex and does not permit the use of a conventional toothbrush cup, as provided by at least one embodiment of the present invention, and does nothing to cover or protect a plurality of toothbrushes with a single cover.

U. S. Pat. No. 4,915,219 issued to Anthony Ottimo on Apr. 10, 1990 describes a Disinfecting Toothbrush Container wherein a flexible membrane divides the upper and lower portion of each individual toothbrush holder, in a container of a plurality of holders. The bottom portion contains a liquid disinfectant. A brush is inserted through a slit in the membrane, so the bristles are submerged in the disinfectant. A lid is also provided, but is disclosed as being liquid-tight, rather than permitting air circulation. The present cover includes a multitude of small air passages therethrough, to promote drying of the exposed bristles while simultaneously protecting them from contact with potential disease carriers.

U. S. Pat. No. 5,139,142 issued to Eric M. Simon on Aug. 18, 1992 describes a Disposable Toothbrush Cover comprising a relatively small sheet of thin, flexible plastic adapted to enclose only the head and bristles of a single toothbrush. The device functions as a disposable version of the case for a single toothbrush head of the Bridges 162 patent discussed further above.

U. S. Pat. No. 5,295,575 issued to Santos O. Gonzalez on Mar. 22 1994 describes a Toothbrush Holder And Room Odorizer, comprising an elongate container providing enclosure for a plurality of toothbrushes therein. One end of the device has a detachable portion with a drying agent therein, while the opposite end includes a symmetrical container having a room odorizer therein. No separate perforated cover adapted to fit atop a conventional toothbrush cup, is disclosed.

U. S. Pat. No. D-291,268 issued to Eric A. Stephenson on Aug. 11, 1987 describes a design for a Toothbrush Container, apparently comprising a relatively low, flat box having a pair of slotted rests therein providing for the placement of a plurality of toothbrushes therein. No ventilation is apparent from the disclosure, nor does any component mate with a conventional cup.

U.S. Pat. No. Design 301,660 issued to Emilio Ambasz on Jun. 20, 1989 describes a design for a Combined Toothbrush And Container Therefor, apparently comprising a toothbrush with a circumferentially ribbed handle integral therewith, and an identically configured elongate cover for the brush end of the device. No ventilation means is apparent, nor is the cover adapted to mate with a cup configured to contain a plurality of toothbrushes therein.

U.S. Pat. No. Design 310,913 issued to Emilio Ambasz on Oct. 2, 1990 describes a design for a Toothbrush And Container Set, apparently comprising a pair of identically configured toothbrushes and handles which mate with one another by means of cooperating channels and flanges in each portion. The assembled toothbrush pair provides complete enclosure for the brush portions of the toothbrushes in a single elongate case. No ventilation is apparent.

Finally, U.S. Pat. No. Design 310,915 issued to Emilio Ambasz on Oct. 2, 1990 describes a design for a Toothbrush And Container Set, wherein two brushes apparently pivot outwardly from a central handle. The handle portion provides a completely closed elongate container when the two brushes are folded therein. Again, no ventilation means is apparent in the device, and the design does not appear to be adaptable to a conventional toothbrush cup capable of holding a plurality of separate toothbrushes therein.

None of the above noted patents, taken either singly or in combination, are seen to disclose the specific arrangement of concepts disclosed by the present invention.

SUMMARY OF THE INVENTION

By the present invention, an improved cover for a toothbrush holder is disclosed.

Accordingly, one of the objects of the present invention is to provide an improved cover for a toothbrush holder which is adapted to fit over a conventional toothbrush cup or the like, and to enclose the upwardly disposed bristle or head portions of a plurality of toothbrushes therein.

Another of the objects of the present invention is to provide an improved cover for a toothbrush holder which includes ventilation means therein, comprising a plurality of small holes therethrough adapted to allow the passage of air therethrough but sufficiently small as to preclude passage of insects and similar airborne disease vectors therethrough.

Yet another of the objects of the present invention is to provide an improved cover for a toothbrush holder which comprises a domed cap configuration to provide sufficient clearance.

Still another of the objects of the present invention is to provide an improved cover for a toothbrush holder which may be formed of plastic, ceramic, or other suitable materials, but which may alternatively be formed of a metal or plastic screen.

A further object of the present invention is to provide an improved toothbrush holder which comprises a toothbrush cup, a disc adapted to fit therein and to hold a plurality of toothbrushes generally upright therein, and a ventilated cover adapted to fit with the cup and toothbrush supporting disc.

A final object of the present invention is to provide an improved cover for a toothbrush holder for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
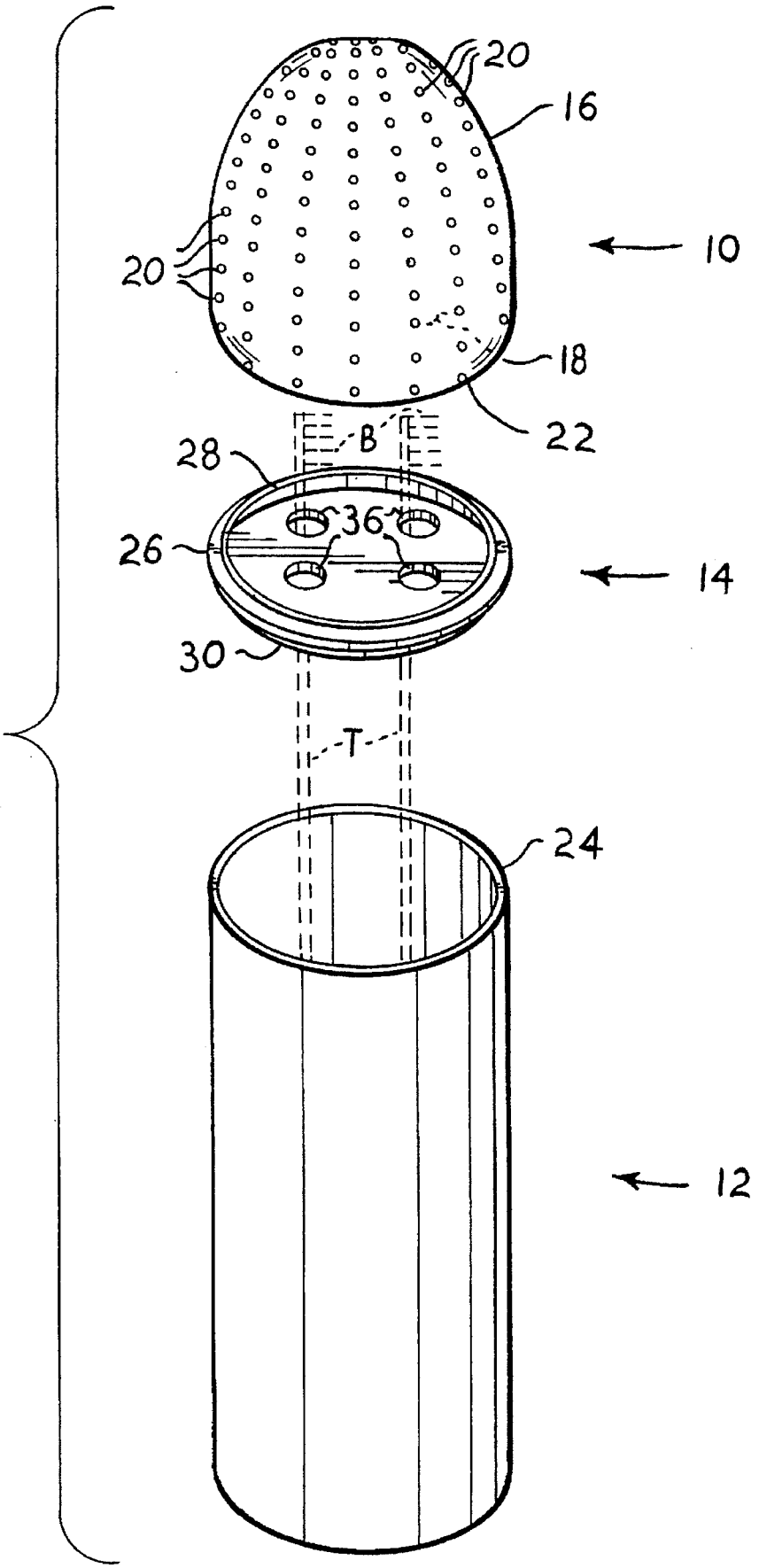
FIG. 1 is an exploded perspective view of the assembly comprising a toothbrush cup, a specially formed disc adapted to fit within the top rim of the cup, and a ventilated cover adapted to fit over the disc, the assembly serving to hold and protectively cover one or more toothbrushes therein.
Figure 2:
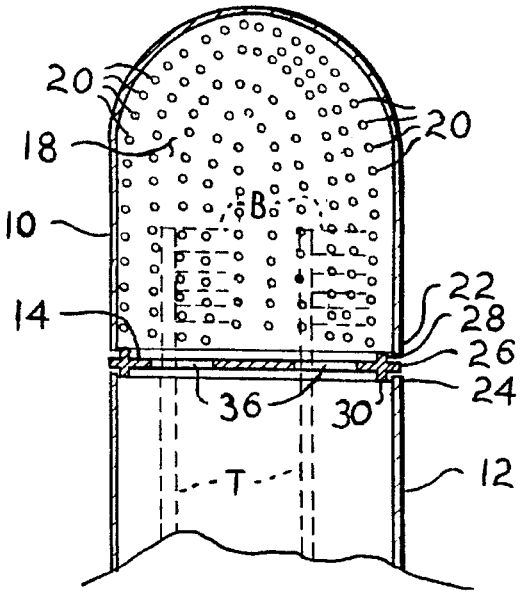
FIG. 2 is a partial elevation view in section of the completed assembly of FIG. 1.

Referring now particularly to FIGS. 1 and 2 of the drawings, the present invention will be seen to relate to a ventilated cover 10 for a toothbrush cup 12 and toothbrush placement disc 14 adapted to fit within the top of the cup 12. (It will be understood that the cover 10 may be provided separately or in combination with a toothbrush cup assembly comprising the cup 12, placement disc 14, and cover 10, if desired.)

The cover 10 generally comprises a dome 16 having a hollow interior 18 and a multitude of very small ventilation holes or perforations 20 which pass through the wall of the dome 16, which holes 20 provide for air circulation through the cover 10 and the bristle ends or heads B of any toothbrushes T which may be contained therein, thus encouraging the drying of the bristles B to preclude microbial growth therein and encourage sanitary storage of the toothbrushes T. The holes 20 are sufficiently small to preclude passage therethrough of various airborne insects and pests which often carry bacterial or microbial disease microorganisms, such as flies, mosquitos, and gnats, as well as other airborne pests of similar size and habits. Thus, the cover 10 provides two benefits, in that the insect borne microbial disease vector to toothbrushes T stored within the cover 10 is eliminated, and the moist environment conducive to microbial reproduction is also eliminated.

The cover 10 includes a base edge portion 22 of substantially the same diameter as that of the rim 24 of the cup 12, and adapted to fit closely therewith and to eliminate any substantial gaps or spaces therebetween when the cover 10 is removably placed over the top of the cup 12. In the embodiment of FIGS. 1 and 2, the toothbrush placement disc 14 has a periphery 26 with a diameter substantially equal to the diameter of the rim 24 of the cup 12, and adapted to rest atop the rim 24 of the cup 12. The disc 14 also has an upper flange 28 and an opposite lower flange 30, with each flange 28 and 30 being inwardly offset from the periphery 26 of the disc 14 by a distance substantially equal to the thickness of the rim 24 of the cup 12. Thus, the disc 14 may be removably placed atop the rim 24 of the cup 12, and positively located thereon by means of the lower flange 30 fitting closely within the rim 24 of the cup 12.

In a like manner, the base edge 22 of the cover 10 is adapted to fit closely about the upper flange 28 of the disc 14, and to rest upon the periphery 26 of the disc 14 when the cover 10, cup 12, and disc 14 are removably assembled together. The periphery 26 of the disc 14 is sandwiched between the rim 24 of the cup 12 and the base edge 22 of the cover 10, thus separating and spacing the cover 10 and the cup 12 from one another when the three components are removably assembled together. The inwardly offset upper flange 28 of the disc 14 serves to locate and position the cover 10 positively on the disc 14, thus also positively locating and positioning the cover 10 relative to the cup 12 due to the positive location of the disc 14 and cup 12 discussed above, when the components are removably placed together.

Figure 3:
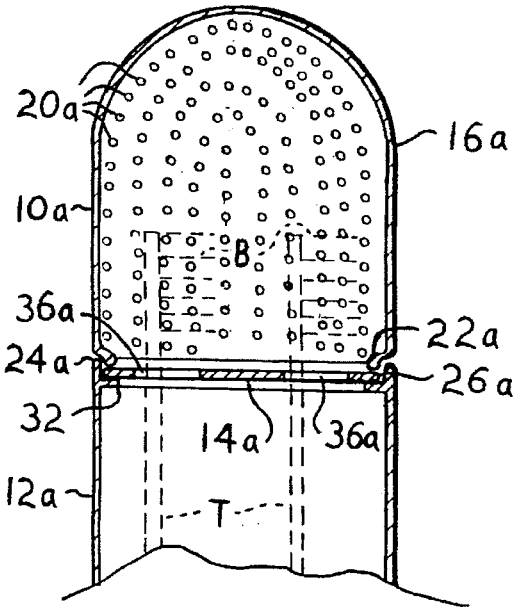
FIG. 3 is a partial elevation view in section of an alternative embodiment of the assembly of FIG. 1.

FIG. 3 provides a cross sectional elevation view of all alternative embodiment or configuration of the above assembly. In the embodiment of FIGS. 1 and 2, the cup 12 may have a smooth rim 24, which is devoid of any specially shaped flanges or other protuberances adapted to hold the disc or other component(s) therein. In the embodiment of FIG. 3, the disc **14*a* is devoid of any upper or lower flanges, but is held within the upper rim 24*a* of the cup 12*a* by means of an inwardly extending flange 32 disposed immediately below the rim 24***a*. The disc 14*a* has a periphery 26*a* with a diameter slightly less than the diameter of the rim 24*a* of the cup 12*a*, but greater than the diameter of the inwardly extending flange 32, with this configuration thus providing for the removable placement and positive location of the disc 14*a* upon the inwardly extending flange 32 and within the cup 12*a*.

The cover 10*a* of FIG. 3 includes an inwardly offset base edge 22*a*, which has a diameter adapted to fit closely within the rim 24*a* of the cup 12*a*, thus being positively positioned relative to the cup 12*a* when the cover 10*a* is removably placed upon the cup 12*a*. (The height of the rim 24*a* extends upwardly sufficiently above the thickness of the disc 14*a* , to allow the base edge 22*a* of the cover 10*a* to seat within the rim 24*a*.) The diameter of the perforated dome portion 16*a* of the cover 10*a* is substantially the same as the diameter of the rim 24*a* of the cup 12*a*, to provide a uniform appearance for the assembly of the cover 10*a*, cup 12*a*, and toothbrush placement disc 14*a*, as well as to provide a sufficiently large interior volume 18*a* to provide ample clearance for any toothbrush bristle portions or heads B which may be contained therein.

The above described cover 10/10*a*, cup 12/12*a*, and disc 14/14*a* may be formed of any of a number of suitable materials. Plastic has been found to work well for all of the above components, as it is durable in the environment of intended use, resisting shattering or breakage when accidentally dropped upon a hard surface, and it may be provided in any of a virtually unlimited number of colors, patterns and/or designs. Alternatively, some persons may desire a somewhat heavier and harder material, and the shapes of the above described components are readily adaptable for formation of ceramic material, if so desired. However, it is understood that a plastic material may be more desirable, due to its increased resilience and resistance to breakage relative to ceramics. Each of the above described components 10/10*a*, 12/12*a*, and/or 14/14*a* may be monolithically formed as a single component with no separate component parts, using either plastic or ceramic material as desired.

Figure 4:
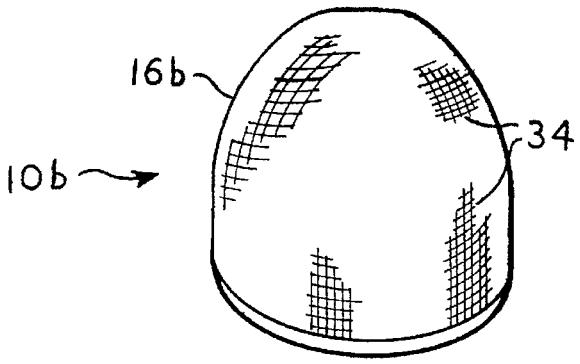
FIG. 4 is a perspective view of an alternate cover embodiment, wherein the cover is formed of a screen.

It should also be noted that at least the dome portion 16/16*a* of the present cover 10/10*a* may be formed of a relatively thin sheet of metal, if desired, with the holes 20/20*a* being punched, drilled, or otherwise formed therein. Preferably, a corrosion resistant metal (e. g., stainless steel) is used, in order to resist the relatively high humidity generally found in the bathroom environment. In fact, the dome portion of the cover may be formed of a plastic, metal, or corrosion resistant metal screen 34, as shown on the dome portion 16*b* of the cover 10*b* of FIG. 4. The screen 34 is of a sufficiently fine mesh so as to preclude passage of flies, mosquitos, gnats, and other airborne pests therethrough, to function in the manner of the holes 20 and 20*a* of the covers 10 and 10*a* discussed above.

In summary, the present cover 10/10*a*/10*b* serves to provide air circulation to the bristle portions B of any toothbrushes T contained within a cup 12/12*a* thereunder, while at the same time precluding direct contact by any flies, mosquitos, gnats, or other airborne pests with the toothbrushes T or brush bristles B contained therein. The cover 10/10*a*/10*b* may be provided separately, or in combination with a toothbrush cup 12/12*a* and toothbrush placement disc 14/14*a*, as discussed above. The appropriate disc 14/14*a* is removably placed within the top of the cup or holder 12/12*a*, and one or more toothbrushes T removably placed within the cup 12/12*a* by passing the toothbrush handles downward through the passages 36/36*a* within the disc 14/14*a* to place and hold the brushes T substantially vertically within the cup 12/12*a* and to separate the brush bristle head portions B from one another. The cover 10/10*a*/10*b* is then placed atop the cup 12/12*a* and disc 14/14*a* to enclose and protect the toothbrushes T.

When a toothbrush T is needed, the cover 10/10*a*/10*b* is lifted from the underlying cup 12/12*a* and the brush T withdrawn. The wet. toothbrush T may be placed back into the cup 12/12*a* and the cover 10/10*a* placed thereover, thereby assuring the user that the toothbrush T will remain in a protected and sanitary condition and yet will receive sufficient air circulation to dry properly. The above described components and their construction of plastic, ceramic, or metal permits them to be cleaned readily and easily, as required or desired for sanitation, and thus provides a significant potential increase in household sanitation and family health.

It is to be understood that the present invention is not limited to the sole embodiments described above, but encompasses any and all embodiments within the scope of the following claims.

I claim:

1. A toothbrush holder cup and cover assembly providing for the generally vertical storage of a plurality of conventional toothbrushes therein, said assembly comprising:

a toothbrush cup including an upper rim and having a hollow interior with a diameter and depth sufficient for the storage of a plurality of toothbrush handles placed generally vertically therein;

a toothbrush placement disc providing for the individual placement of a plurality of toothbrush handles therethrough, said disc having a plurality of toothbrush handle passages therethrough and a periphery adapted for removable placement atop said upper rim of said cup, said periphery of said toothbrush placement disc has a diameter substantially equal to said rim of said cup and an upper flange and an opposite lower flange each inwardly offset from said periphery of said disc, with said disc being adapted for removable placement atop said rim of said cup with said lower flange of said disk fitting closely within said rim of said cup to provide positive location of said disc upon said cup, and;

a ventilated cover, comprising a peripheral base edge adapted to fit closely and removably adjacent said periphery of said disc and said rim of said cup and a ventilated dome portion extending upwardly from said base edge, with said ventilated dome portion including a hollow interior having sufficient space therein to provide clearance for a plurality of conventional toothbrush bristle ends therein and further including a plurality of small ventilation holes therethrough, said cover is adapted for removable placement atop said disc with said upper flange of said disc fitting closely within said peripheral base edge of said cover to provide positive location of said cover upon said disc, so that said periphery of said disc is sandwiched between said rim of said cup and said base edge of said cover and said cup and said cover are separated from one another by said disc when said cup, said disc, and said cover are assembled, whereby;

said cover is removably placed over said toothbrush placement disc and atop said rim of said toothbrush holder cup to provide for air circulation within said cover and through the bristles of any toothbrushes stored thereunder by means of said ventilation holes in said cover.

2. The toothbrush holder cup and cover assembly of claim 1, wherein:

said cup includes an inwardly extending flange below said rim, and said periphery of said toothbrush placement disc has a diameter less than said rim of said cup but greater than said inwardly extending flange of said cup, with said disc being adapted for removable placement within said cup to rest upon said inwardly extending flange of said cup, and;

said peripheral base edge of said cover is inwardly offset and adapted to fit closely within said rim of said cup and above said periphery of said disc when said cup, said disc, and said cover are separably assembled together.

3. The toothbrush holder cup and cover assembly of claim 1, wherein:

at least said cover is monolithically formed as a single, unitary component.

4. The toothbrush holder cup and cover assembly of claim 1, wherein:

said cup, said disc, and said cover are each formed of plastic material.

5. The toothbrush holder cup and cover assembly of claim 1, wherein:

said cup, said disc, and said cover are each formed of a ceramic material.

6. The toothbrush holder cup and cover assembly of claim 1, wherein:

at least said cover is formed of a corrosion resistant metal.

7. The toothbrush holder cup and cover assembly of claim 1, wherein:

at least said ventilated dome portion of said cover is formed of a fine mesh plastic screen.

8. The toothbrush holder cup and cover assembly of claim 1, wherein:

at least said ventilated dome portion of said cover is formed of a fine mesh corrosion resistant metal screen.

* * * * *